US008007241B2

(12) United States Patent
Vadillo

(10) Patent No.: US 8,007,241 B2
(45) Date of Patent: Aug. 30, 2011

(54) BI-DIRECTIONAL COOLING FAN

(75) Inventor: Jose L. Vadillo, St. Louis, MO (US)

(73) Assignee: Nidec Motor Corporation, St. Louis, MO (US)

( * ) Notice: Subject to any disclaimer, the term of this patent is extended or adjusted under 35 U.S.C. 154(b) by 274 days.

(21) Appl. No.: 12/323,099

(22) Filed: Nov. 25, 2008

(65) Prior Publication Data

US 2009/0136357 A1 May 28, 2009

Related U.S. Application Data

(60) Provisional application No. 60/990,517, filed on Nov. 27, 2007.

(51) Int. Cl.
*F01D 5/14* (2006.01)

(52) U.S. Cl. ..... 416/203; 416/228; 416/241 R

(58) Field of Classification Search ..... 416/175, 416/183, 185, 188, 195, 203, 223 B, 228, 416/186 R See application file for complete search history.

(56) References Cited

U.S. PATENT DOCUMENTS

| | | | | |
|---|---|---|---|---|
| 2,205,902 | A | 6/1940 | McMahan | |
| 2,247,817 | A | 7/1941 | McMahan | |
| 2,434,847 | A | 1/1948 | Hagen | |
| 2,458,006 | A | 1/1949 | Kilgore | |
| 2,519,151 | A | 8/1950 | Overweg | |
| 2,704,516 | A * | 3/1955 | Mock et al. | 415/56.5 |
| 3,228,475 | A * | 1/1966 | Worthmann | 416/188 |
| 3,285,328 | A | 11/1966 | Woodward | |
| 3,904,308 | A * | 9/1975 | Ribaud | 415/143 |
| 4,900,228 | A * | 2/1990 | Yapp | 416/183 |
| 4,904,158 | A * | 2/1990 | Kun | 416/183 |
| 5,156,535 | A | 10/1992 | Budris et al. | |
| 5,213,473 | A * | 5/1993 | Fiala | 416/183 |
| 6,435,828 | B1 | 8/2002 | Bostwick | |
| 6,514,052 | B2 * | 2/2003 | Bostwick | 417/366 |
| 6,663,347 | B2 * | 12/2003 | Decker et al. | 416/185 |
| 7,157,818 | B2 | 1/2007 | Jones | |
| 2003/0235496 | A1 | 12/2003 | Eaton et al. | |
| 2004/0005220 | A1 | 1/2004 | Kawamoto et al. | |

(Continued)

FOREIGN PATENT DOCUMENTS

WO WO 2006/013067 A2 2/2006

(Continued)

OTHER PUBLICATIONS

Photographs of motor Model No. K48ZZDRY-3152 by Emerson Electric Co., sold prior to 2006.

*Primary Examiner* — Justine Yu
*Assistant Examiner* — Aaron R Eastman
(74) *Attorney, Agent, or Firm* — Maginot, Moore & Beck LLP

(57) ABSTRACT

A radial fan comprises a base with a plurality of straight primary blades radially oriented and substantially uniformly spaced around the circumference of the base. A like plurality of splitter vanes are interspersed between successive primary blades. The splitter vanes have a length that is about 50-70% of the length of the primary blades. The inner edges of the splitter vanes are angled to improve airflow through the inlet area between primary blades while reducing the occurrence of vortices and recirculation. The addition of splitter vanes increases the airflow capacity of the fan without any significant increase in operating noise.

20 Claims, 5 Drawing Sheets

U.S. PATENT DOCUMENTS

2004/0202539 A1 10/2004 Blank et al.
2005/0042105 A1* 2/2005 Nishiyama et al. ..... 416/183
2005/0047088 A1* 3/2005 Xu et al. ..... 361/695
2005/0163614 A1 7/2005 Chapman
2005/0196272 A1 9/2005 Nikpour
2005/0214115 A1 9/2005 Yeck
2006/0088412 A1 4/2006 Barton et al.
2007/0014666 A1* 1/2007 White ..... 416/179
2007/0031261 A1* 2/2007 Lombard et al. ..... 416/203
2007/0036645 A1 2/2007 Baker et al.
2007/0039709 A1* 2/2007 Endo et al. ..... 164/76.1
2007/0134098 A1 6/2007 Huber et al.
2007/0154314 A1 7/2007 Jarrah et al.
2007/0160461 A1 7/2007 Lee
2007/0227516 A1 10/2007 Middlebrook et al.
2007/0231141 A1* 10/2007 Chaing et al. ..... 416/185
2008/0213093 A1* 9/2008 Guelich ..... 416/1
2008/0289332 A1* 11/2008 Decker et al. ..... 60/605.1
2009/0274560 A1* 11/2009 Kubota et al. ..... 416/228

FOREIGN PATENT DOCUMENTS

WO WO 2006013067 A2 * 2/2006

* cited by examiner

BI-DIRECTIONAL COOLING FAN

REFERENCE TO RELATED APPLICATION

The present application claims priority to U.S. provisional application No. 60/990,517, filed on Nov. 27, 2007, in the name of the present inventor, the disclosure of which is incorporated herein by reference.

BACKGROUND

The present invention pertains to cooling fans mounted to the shafts of electric motors and other similar dynamoelectric devices.

Many dynamoelectric devices, such as appliance motors for dishwashers, clothes washers, and the like, and large industrial motors, utilize a fan mounted on the rotating shaft of the device for cooling a stator, a rotor, a motor housing, and other components of the dynamoelectric device during operation. In one configuration, such a fan is mounted at one axial end of the motor and is configured to pull and/or push air through and/or adjacent the motor housing to cool the components. Such a fan can be mounted within a vented housing, as depicted in FIG. 1, to protect the rotating fan and to control the airflow into and through the fan.

As shown in the exemplary embodiment of FIG. 1, a motor is cylindrical in shape and a cooling fan is configured to fit within the radial footprint of the motor. The fan is configured to require a minimum amount of space, while providing sufficient air flow over the operating components of the motor. While axial flow fans may be used in some applications, it is often desirable to use radial flow fans that discharge air radially outwardly as the fan rotates. A fan grill and the motor housing are configured to direct this radial air flow across the critical components, such as axially of the motor, as illustrated by the air flow arrows moving from left to right in FIG. 1.

In order to control the direction of the air drawn into the fan, a typical straight blade fan will include a disc-shaped base or backing wall that blocks the flow of air axially through the fan. This feature allows the fan to generate a negative pressure at the center of the rotating fan facing the motor. This negative pressure in turn draws airflow from the opposite axial end of the motor, as represented by the airflow arrows at the right side of the motor housing shown in FIG. 1. This counterflow increases the heat dissipation between the solid body (the motor components) and the adjoining fluid (the airflow), thereby facilitating the cooling capability. This feature is due to an increase in the forced convection, which increases the fluid velocity and consequently increases the convection coefficient. In general, radial fans produce low airflow capacity and high head pressure, while axial fans produce high airflow capacity and low head pressure.

One type of radial fan is shown in FIG. 2. Details of this fan are found in U.S. Pat. No. 6,514,052, the disclosure of which is incorporated herein by reference. The fan includes straight, flat blades radiating radially outward from a central hub. The hub is mounted to the motor shaft for rotation of the fan as the motor is operating. The radial blades are flat and generally rectangular in shape.

Another motor and fan arrangement is illustrated in FIG. 3. In this configuration, the fan directs airflow over cooling fins projecting from the outside of the motor housing. The fan in FIG. 3 incorporates straight, flat blades radiating outward from a central hub which direct airflow radially outward across the base plate as the fan rotates with the motor.

One benefit of the straight blade radial fan designs shown in FIGS. 1-3 is that the fans may operate in opposite directions of rotation. In other words, the blades produce the same radial airflow whether the fan is rotated in the clockwise or counterclockwise directions. This feature allows the fan to be mounted on either end of the motor shaft or to be used on a reversible motor without sacrificing any cooling capability. This attribute of the straight, flat blade fan provides a benefit over fans that utilize curved blades, such as axial flow devices, impeller devices, or uni-directional fans.

In order to meet more stringent design requirements, modifications in bi-directional fans (i.e., reversible fans) are continually sought to increase airflow capacity, increase fan/pump efficiency, increase the operating air pressure, and reduce the operating noise of the fan. As dynamoelectric device designs improve, the components operate at increasingly higher temperatures. These increased operating temperatures dictate the need for higher heat dissipation rates to maintain low temperature levels. In some cases, reducing the size of the dynamoelectric device dictates the need for increased air pressure to force air through smaller paths around the operating components. The cooling fan should meet these enhanced requirements without any increase in overall size, and sometimes with a decrease in size to match a decrease in size of the corresponding dynamoelectric device.

Moreover, noise reduction is often important, especially for dynamoelectric devices used in consumer appliances, such as dishwashers and clothes washers, as well as large industrial motors operating within specifications (e.g., operator health specifications). For example, noise levels above 85 dBA are undesirable in consumer appliances. Lower noise can provide a selling point for an appliance. Since the cooling fan can be the primary noise generator in these appliances, the focus for noise abatement is necessarily directed at the fan.

SUMMARY

In accordance with the embodiments of the present invention, it has been found that incorporating splitter vanes between the straight blades of a radial flow, bi-directional fan is advantageous. In particular, the addition of splitter vanes increases air pressure through the cooling device, improves the flow efficiency by reducing recirculation areas between blades, and reduces operating noise.

In one embodiment, a radial fan comprises a base defining a central hub for engagement to a source of rotation about an axis of rotation. A plurality of primary blades are connected to the base which are radially oriented and spaced around the circumference of said base. Each primary blade has an outer edge that can be substantially flush with an outer edge of said base plate and an inner edge that terminates adjacent the central hub. The outer and inner edges may extend generally parallel to the axis of rotation. Each primary blade has a primary length from the outer edge to the inner edge.

In one feature, a plurality of splitter vanes are connected to the base and are interspersed the primary blades. Each splitter vane has a vane outer edge that may be substantially flush with the outer edge of the base plate and a vane inner edge that terminates radially outboard of the inner edge of each of the primary blades, and is thus radially offset from the central hub of the base. Each splitter vane may have a vane length from the vane outer edge to the vane inner edge that is about 50-70% of the primary length of the primary blades.

The inner edge of each splitter vane is arranged at an angle relative to the base of the vane. In certain embodiments, the inner edge is at an angle of about 60°-70° relative to the vane base. This angle, combined with the shorter length of the splitter vanes increases flow capacity of the fan without any appreciable increase in operating noise. Moreover, the arrangement of the inner edge of the splitter vanes reduces the occurrence of recirculation and vortices of the airflow at the inlet region between primary blades.

DESCRIPTION OF THE EMBODIMENTS

Figure 1:
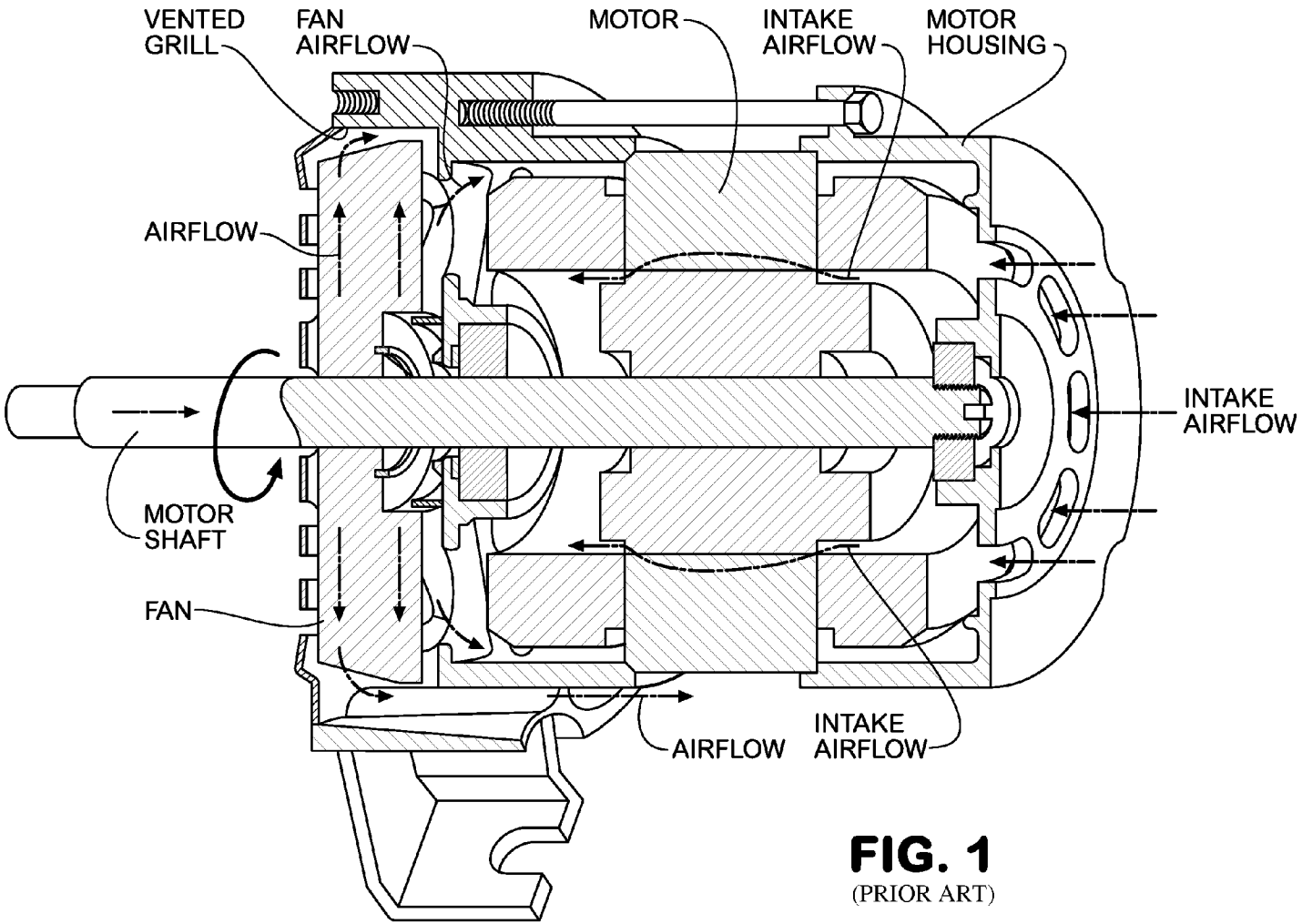
FIG. 1 (PRIOR ART)
FIG. 1 is a side cross-sectional view of a motor and cooling fan arrangement adapted to utilize the cooling fan of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
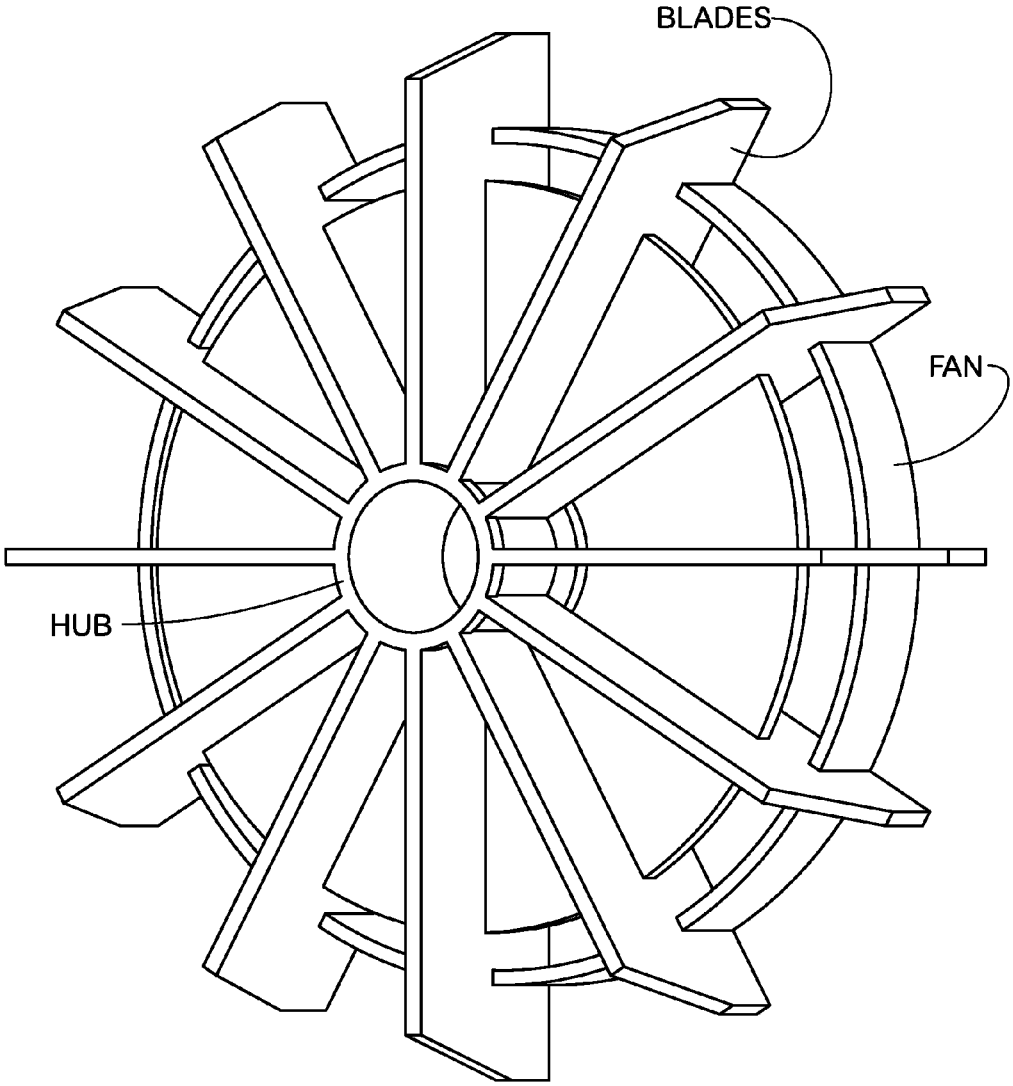
FIG. 2 (PRIOR ART)
FIG. 2 is a perspective view of a prior straight blade cooling fan.
Figure 3:
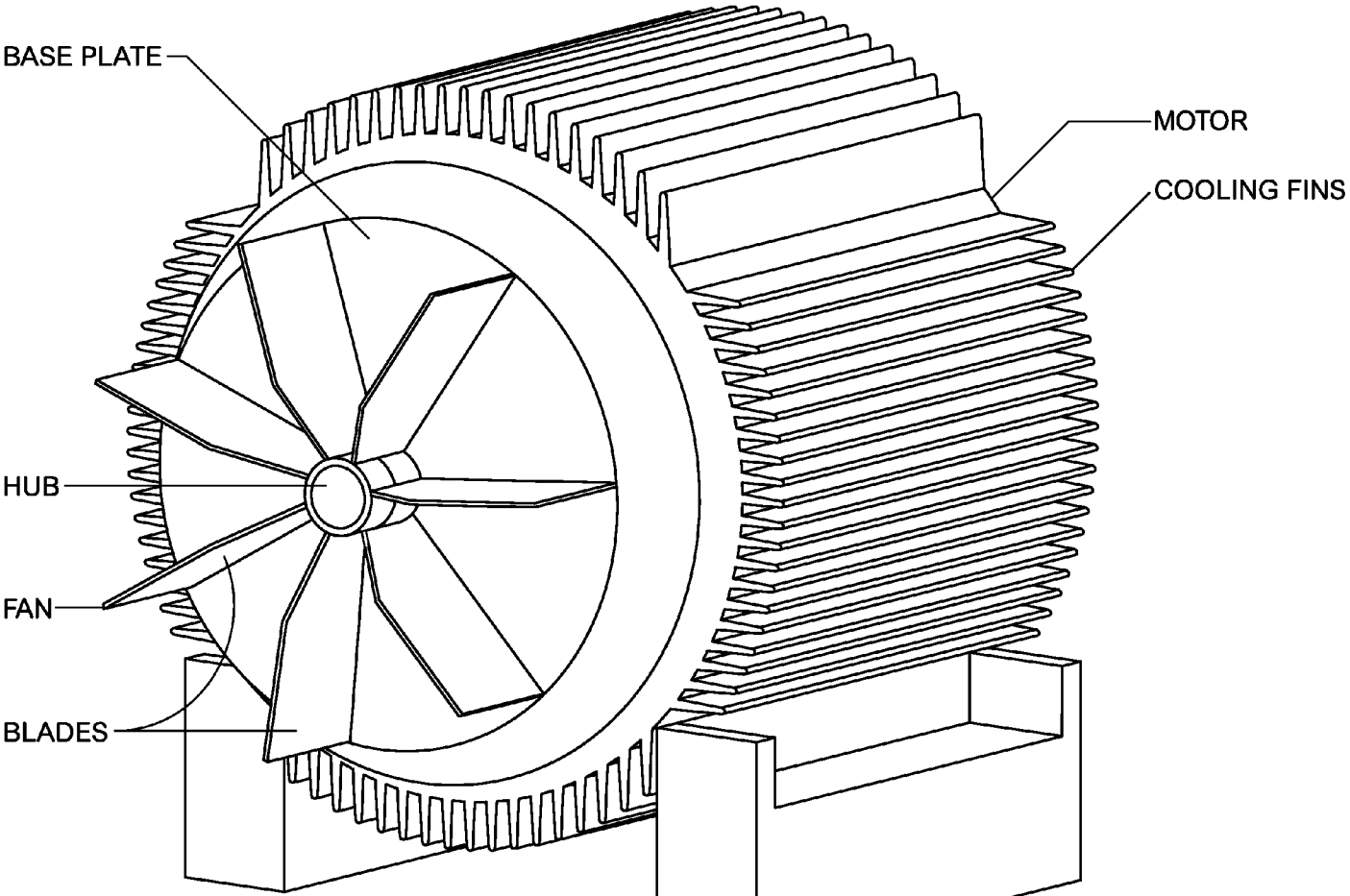
FIG. 3 (PRIOR ART)
FIG. 3 is a perspective view of another motor and cooling fan arrangement adapted to utilize the cooling fan of the present invention.
Figure 4:
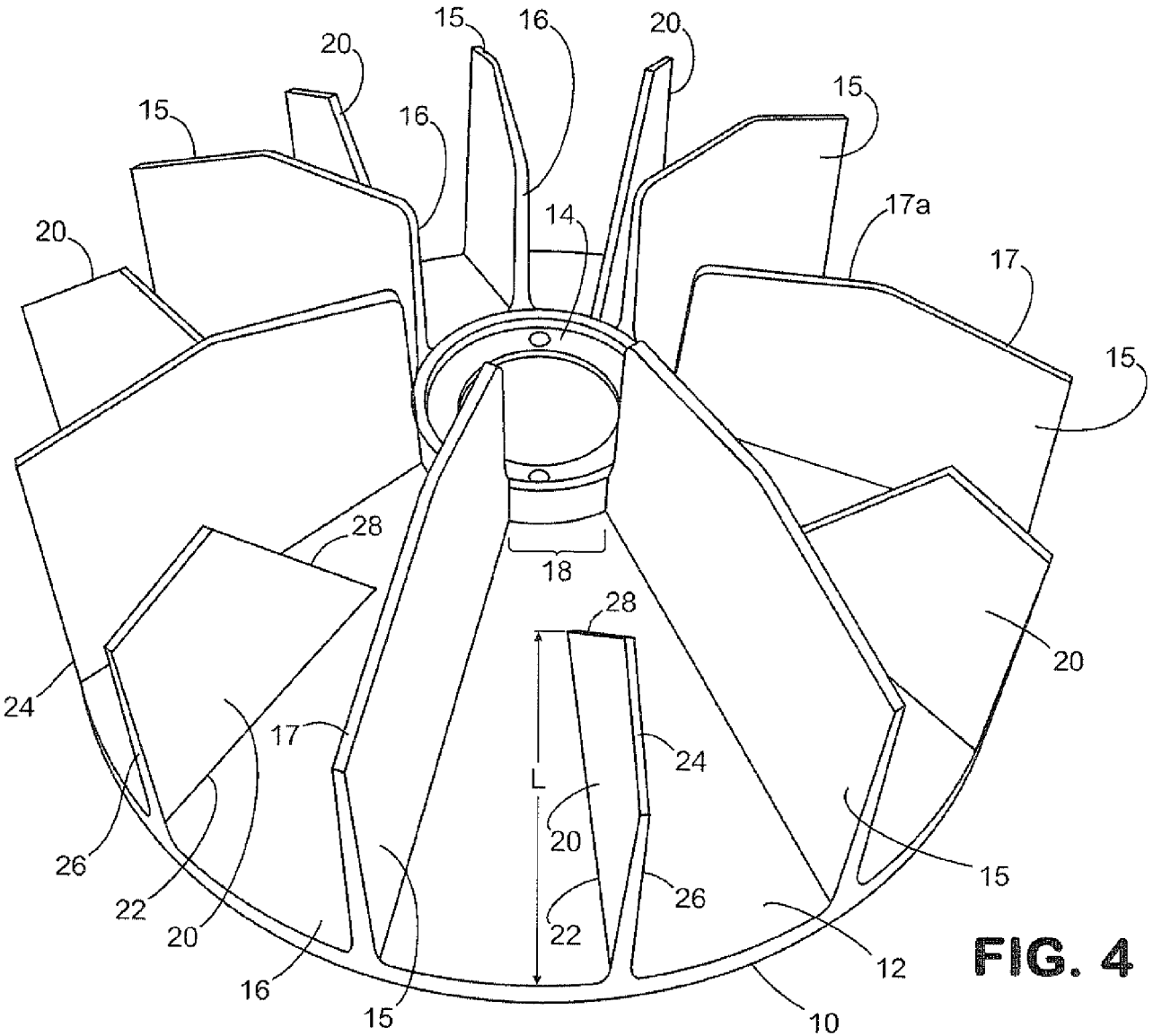
FIG. 4 is a perspective view of a radial cooling fan according to one embodiment of the present invention.

In accordance with one embodiment of the invention, a radial fan 10 is provided as shown in FIG. 4. This radial fan 10 may replace the straight blade fans shown in FIGS. 1-3. The fan 10 includes a base plate 12 with a central hub 14 configured to be mounted on the motor shaft of a dynamoelectric device in a conventional manner. In the illustrated embodiment, the base plate 12 is slightly conical to help direct the airflow radially outwardly, as well as to increase the specific speed of the airflow, which increases flow capacity and decreases pressure head. However, the plate 12 may be flat or in any other suitable configuration depending upon the cooling requirements for the particular dynamoelectric device.

The fan 10 includes a plurality of planar primary blades 15 projecting radially outwardly from and extending perpendicular to the base plate 12. The primary blades 15 are oriented radially and extend from proximate the hub 14 to or near an outer rim 13 of the base plate 12. The radially outward edges 16 of the blades may be generally flush with the outer rim 13. In the illustrated embodiment, upper edges 17 of the blades 15 are substantially parallel to the base plate 12. In certain embodiments, portions 17*a* of each of the upper edges approaching the hub 14 may extend perpendicular to a rotational axis of the fan 10, rather than substantially parallel to the base plate 12. This feature reduces the axial length of the fan without appreciable impact on the flow capacity of the fan. Thus, as illustrated in FIG. 4 the radially inward portion 17*a* is angled relative to the remainder of the upper edge 17. Upper edges 17 having other profiles are also contemplated as within the scope of embodiments of the present invention. In the illustrated embodiment, seven (7) such blades 15 are provided that are substantially evenly distributed around the circumference of the base plate 12. Other numbers of blades may be included depending upon the flow requirements for the particular application.

In accordance with one feature of the exemplary embodiments of the present invention, a plurality of splitter vanes 20 are interspersed among the primary blades 15. As shown in FIG. 4, each splitter vane 20 bisects the space between successive blades 15. A base 22 of each blade is associated with the base plate 12 in a conventional manner. For example, the vanes 20 may be engaged to, welded to, adhered to, or integrally formed with, the base plate 12. In one exemplary embodiment, an outer edge 26 of each splitter vane 20 is located at or adjacent the outer rim 13 of the base plate 12, in the same manner as the blades 15. Upper edges 24 of the vanes 20 may be coplanar with the upper edges 17 of the primary blades 15.

As thus far described, each splitter vane 20 is substantially similar in construction to each of the blades 15. But as illustrated in FIG. 4, an inner edge 28 of each vane is different from an inner edge 16 of each primary blade 15. In particular, the inner edge 28 of each vane is truncated relative to the inner edge 16 of the blade 15. Thus, while the inner edge 16 of each primary blade 15 is adjacent the hub 14, the inner edge 28 of each splitter vane 20 is offset from the hub. More specifically, each primary blade 15 has a radial length extending from the outer edge 16 to nearly the hub 14. On the other hand, each splitter vane 20 has a radial length L of between about fifty percent (50%) and about seventy percent (70%) of the radial length of each primary blade. This feature ensures that the inner edge 28 of the splitter vane 20 does not interfere with an inlet region 18 between the inner edges 16 of successive primary blades 15. Thus, the air entering the inlet region 18 is not reduced, which ensures that the splitter vanes 20 do not noticeably diminish the airflow entering the fan 10.

The addition of a like number of splitter vanes 20 to the plurality of blades 15 increases the total air pressure generated by the fan 10 due to the commensurate increase in blade/vane surface area adding energy to the air as the fan 10 rotates. But because the splitter vanes 20 are radially shorter than the primary blades 15, the splitter vanes operate more quietly than the primary blades. Thus, in one example, the combination of the seven primary blades 15 with seven splitter vanes 20 produces an air pressure and an air flow that is substantially similar to the air flow of a fan with fourteen primary blades, but with significantly less noise. Put in other terms, a fan having seven blades can provide increased airflow with the addition of seven splitter vanes without any appreciable increase in fan noise.

In some embodiments it may be desirable to include more than one splitter vane between successive primary blades. Thus, in a specific embodiment, two splitter vanes may be uniformly placed between successive pairs of primary blades, provided there is sufficient circumferential space between the primary blades, particularly at the inboard edges of the splitter vanes.

The splitter vanes 20 also improve the radial airflow efficiency of the fan. In a typical seven blade fan (such as the fan in FIG. 3), recirculation areas or vortices typically arise at the radially outboard edges of the blades, particularly in non-shrouded fan designs. Recirculation may also occur at the upper edges 17 of the blades, which reduces the "absorption" of inlet air into the fan 10. The splitter vanes 20 operate to reduce this form of recirculation so that the rate of "absorption" is maintained. The splitter vanes 20 significantly reduce the onset and magnitude of these recirculation areas at the radially outward spaces between each pair of adjacent primary blades. The angled inner edge 28 provides smooth airflow over the splitter vane 20 and substantially eliminates any vortices that may arise at the upper and inner edges.

Figure 5:
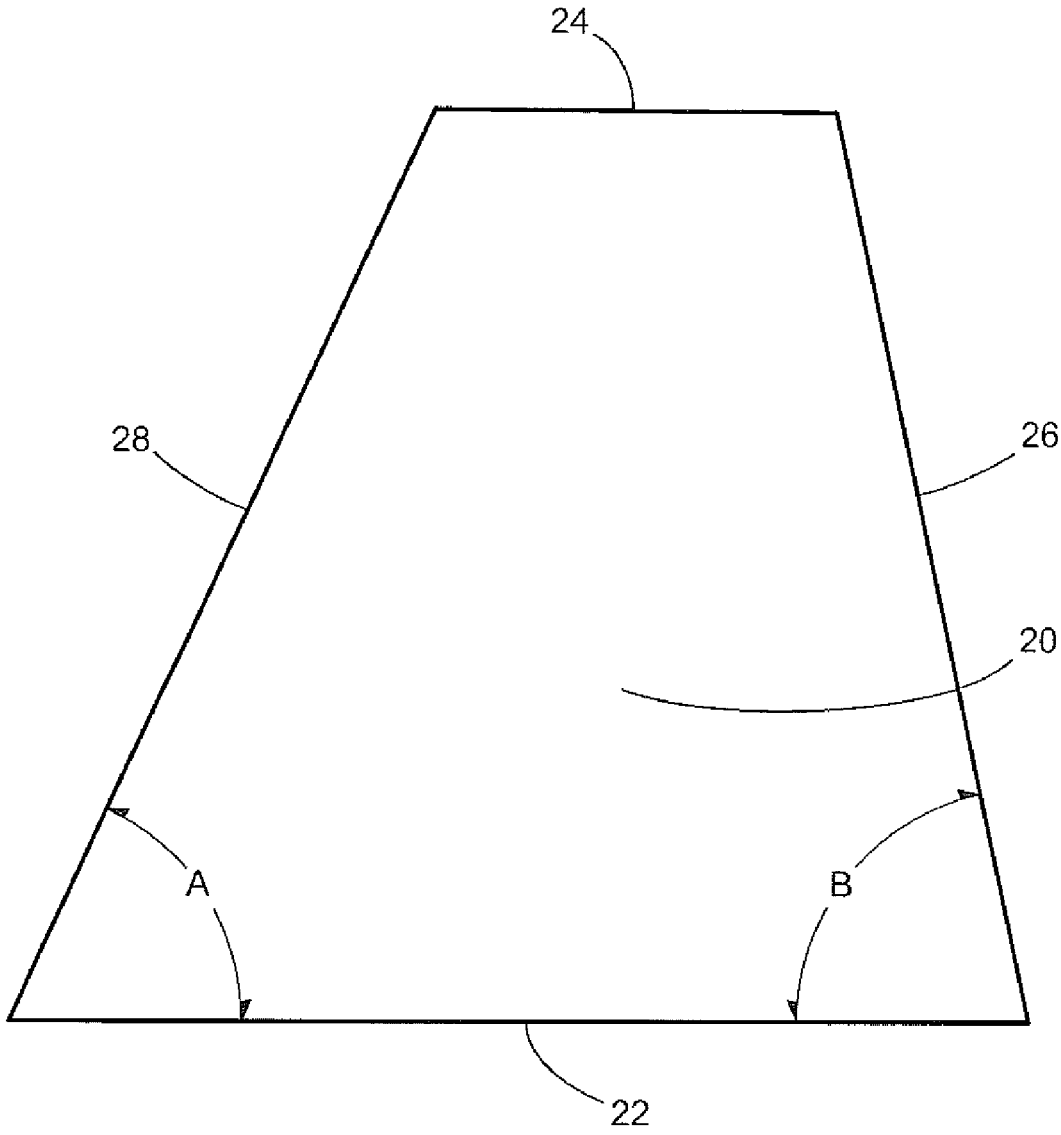
FIG. 5 is a planar view of a splitter vane design according to described embodiments.

An exemplary embodiment of the splitter vane 20 is shown in the planar view of FIG. 5. In this view, the overall planar configuration of the splitter vane is revealed in which the base 22 and upper edge 24 are substantially parallel but of different lengths. The outboard edge 26 is angled inwardly from the base to the upper edge at an angle B relative to the base 22. This angle is zero for splitter blades affixed to a planar base and is non-zero for a conical base, such as the base 12 shown in FIG. 4. More specifically, the angle B is preferably complementary to the angle of the conical base so that the outer edge 26 resides substantially parallel to the axis of rotation of the fan 10.

As shown in FIG. 5, the inner edge 28 is aligned at an angle A relative to the base 22. This angle A is non-parallel with the axis of rotation of the fan and is oriented to optimize the performance of the splitter vane, while minimizing its impact on the inlet air flow through the inlet 18. A preferred range of angles A is between about 60°-70° relative to the vane base 22. For a non-conical or flat base plate, this corresponds to complementary angle of 20°-30° relative to the axis of rotation. For a conical base plate, the conical angle of the plate is added to this complementary angle. Thus, for the conical base plate 12 of the illustrated embodiment, the conical angle of the plate is about 110 so that the inner edge 28 of the splitter vane will be at an angle of about 31°-41° relative to the axis of rotation. It has been found that this angle of the inner edge of the splitter vane helps direct air from the upper edges toward the inlet regions 18 between the primary blades and minimizes the occurrence of vortices.

In a specific embodiment, the vane 20 has a height of about 11.5 cm, which is comparable to the height of the straight radial blades 15. The inner edge 28 extends at an angle A of about 65° while the outboard edge 26 extends at an angle B of about 80° relative to the base 22. For a standard 16" fan, the base 22 may have a length of about 13 cm, as compared to the length of the primary blade of about 17.5 cm. The length of the upper edge 24 is about 5 cm, as compared with the 17.5 cm length of the upper edge of the primary blade. In the exemplary embodiment, the splitter vanes and straight blades preferably have the same height. Preferably the dimensions of the splitter vanes are increased or decreased commensurately for larger or smaller fans, preferably maintaining the radial length L of the splitter vanes at between about fifty percent (50%) and about seventy percent (70%) of the radial length of each primary blade.

In some applications it is desirable to use splitter vanes that fall outside the 50-70% radial length envelope. Thus, in these applications, the splitter vane radial length L may be less than 50% of the length of the primary blades, typically in the range of 30-45% of the primary blade length. In the shorter vane embodiment, the height from the base 22 to the top edge 24 is also proportionately decreased while the angles A and B of the outer and inner edges 26, 28 relative to the base are unchanged.

In the exemplary embodiment, the splitter vane 20 has a surface area of about 100 $cm^2$, while the primary blade 20 has a surface area of about 200 $cm^2$. Thus, each splitter vane 20 has a surface area that is about one-half of the surface area of each blade 20, which means that the relative flow generating capacity of the vanes is less. But the splitter vanes 20 add airflow capacity to the existing blades 20 without significant impact on operating noise and at locations within the fan 10 where unwanted recirculation occurs. This additional flow capacity carries with it improved flow efficiency. Moreover, the present fan produces increased and efficient airflow without requiring larger (e.g., greater diameter or height) blades, as would otherwise be necessary to increase airflow. For example, in the illustrated embodiment, the diameter of the fan is about 16 inches, but the addition of the splitter vanes produces airflow comparable to a fan having a diameter of about 20 inches.

In addition to the airflow benefits afforded by the splitter vanes, the exemplary cooling fan 10 is capable of bi-directional operation. The fan 10 may be mounted on either end of the output shaft of a dynamoelectric device, or may be mounted on a reversible motor. Thus, the fan 10 retains the bi-directional operation capabilities of a straight blade fan while improving flow and maintaining or reducing operating noise.

It is contemplated that the fan 10 may be formed of a variety of materials suitable for the particular application, for instance a metal, such as stainless steel, or a plastic material, such as polyurethane. The fan 10 may be integrally formed in a powdered metal process, or in a molding or a casting process. The fan may also be formed by affixing the blades and vanes to the base plate in a suitable manner, such as by welding, adhesion, or mechanical fasteners.

Embodiments of the fan 10 of the present invention may be used in a variety of applications calling for radial flow cooling. For example, embodiments of the fan 10 of the present invention may be utilized to cool motors in appliances and larger, industrial motors, while other applications are also contemplated as within the scope of embodiments of the present invention.

What is claimed is:

1. A radial fan comprising:

a conical base defining a central hub for engagement to a source of rotation about an axis of rotation;

a plurality of primary blades radially oriented and spaced around the circumference of said conical base, each primary blade having an outer edge that terminates adjacent an outer edge of said conical base and an inner edge that terminates adjacent said central hub, each primary blade having a primary length from said outer edge to said inner edge, wherein each primary blade has a blade base connected to said conical base and an opposite upper edge having a portion that is substantially parallel to said conical base and a portion that is substantially perpendicular to the axis of rotation of said conical base along said primary length; and a plurality of splitter vanes interspersed between successive primary blades and radially oriented on said conical base, said splitter vanes each having a vane outer edge that terminates adjacent the outer edge of said conical base and a vane inner edge that terminates radially outboard of the inner edge of each of said primary blades, said splitter vanes each having a vane length from said vane outer edge to said vane inner edge that is about 50-70% of said primary length.

2. The radial fan of claim 1, wherein:

each splitter vane has a vane base connected to said conical base; and said vane inner edge is at a non-perpendicular angle relative to said vane base.

3. The radial fan of claim 1, wherein said vane inner edge is at an angle of between about 60°-70° relative to said vane base.

4. The radial fan of claim 3, wherein said vane inner edge is at an angle of about 65° relative to said vane base.

5. The radial fan of claim 1, wherein:

each primary blade has a blade base connected to said conical base and an opposite upper edge substantially parallel to and at a height above said conical base; and each splitter vane has a vane base connected to said conical base and an opposite vane upper edge substantially parallel to and at said height above said vane base.

6. The radial fan of claim 1, wherein:

said vane outer edge is at an angle relative to said vane base so that said vane outer edge extends generally parallel to said axis of rotation.

7. The radial fan of claim 1, wherein:

said inner edge of each primary blade extends generally parallel to said axis of rotation; and said vane inner edge extends non-parallel to said axis of rotation.

8. The radial fan of claim 1, wherein said plurality of primary blades are substantially straight.

9. The radial fan of claim 1, wherein at least one splitter vane is disposed between successive pairs of primary blades.

10. The radial fan of claim 1, wherein said plurality of splitter vanes are substantially straight.

11. A radial fan comprising:

a conical base defining a central hub for engagement to a source of rotation about an axis of rotation;

a plurality of primary blades radially oriented and spaced around the circumference of said conical base, each primary blade having an outer edge that terminates adjacent an outer edge of said conical base and an inner edge that terminates adjacent said central hub, each primary blade having a primary length from said outer edge to said inner edge, wherein each primary blade has a blade base connected to said conical base and an opposite upper edge having a portion that is substantially parallel to said conical base and a portion that is substantially perpendicular to the axis of rotation of said conical base along said primary length; and a plurality of splitter vanes interspersed between successive primary blades and radially oriented on said conical base, said splitter vanes each having a vane outer edge that terminates adjacent said outer edge of said conical base and a vane inner edge that terminates radially outboard of the inner edge of each of said primary blades.

12. The radial fan of claim 11, wherein:

each splitter vane has a vane base connected to said conical base; and said vane inner edge is at a non-perpendicular angle relative to said vane base.

13. The radial fan of claim 11, wherein: said upper edge of each primary blade has a height above said conical base; and each splitter vane has a vane base connected to said conical base and an opposite vane upper edge substantially parallel to and at said height above said vane base.

14. The radial fan of claim 11, wherein:

said inner edge of each primary blade extends generally parallel to said axis of rotation; and said vane inner edge extends non-parallel to said axis of rotation.

15. The radial fan of claim 14, wherein said outer and inner edges of said primary blades extend generally parallel to the axis of rotation.

16. The radial fan of claim 11, wherein said plurality of primary blades are substantially straight.

17. The radial fan of claim 11, wherein said plurality of splitter vanes are substantially straight.

18. A bi-directional radial fan adapted for rotation in clockwise or counter-clockwise directions, said fan comprising:

a conical base defining a central hub for engagement to a source of rotation about an axis of rotation;

a plurality of straight primary blades radially oriented and spaced around the circumference of said conical base plate, each primary blade having an inner edge that terminates adjacent said central hub and an outer edge that terminates outboard of said inner edge, each primary blade having a primary length from said outer edge to said inner edge, wherein each primary blade has a blade base connected to said conical base and an opposite upper edge having a portion that is substantially parallel to said conical base and a portion that is substantially perpendicular to the axis of rotation of said conical base along said primary length; and at least one straight splitter vane interspersed between two successive primary blades and radially oriented on said conical base, each splitter vane having an inner edge and an outer edge defining a vane length from said outer edge to said inner edge that is less than said primary length of the primary blades.

19. The bi-directional fan of claim 18, wherein said vane length is about 50-70% of said primary length.

20. The bi-directional fan of claim 18, wherein said outer edges of said primary blades and said outer edges of said splitter vanes are substantially flush with said outer edge of said conical base plate.

* * * * *